US006776260B2

(12) United States Patent
Cjepa

(10) Patent No.: US 6,776,260 B2
(45) Date of Patent: Aug. 17, 2004

(54) SAFETY NET

(75) Inventor: Vlado Cjepa, Hoppers Crossing (AU)

(73) Assignee: Cannon Hill Pty Ltd, Werribee (AU)

( * ) Notice: Subject to any disclaimer, the term of this patent is extended or adjusted under 35 U.S.C. 154(b) by 0 days.

(21) Appl. No.: 09/929,892

(22) Filed: Aug. 15, 2001

(65) Prior Publication Data

US 2002/0020584 A1 Feb. 21, 2002

(51) Int. Cl.[7] ..... A62B 1/22
(52) U.S. Cl. ..... 182/138; 182/137; 182/82
(58) Field of Search ..... 182/138, 82, 137

(56) References Cited

U.S. PATENT DOCUMENTS

| | | | | |
|---|---|---|---|---|
| 3,222,739 A | * | 12/1965 | Davis | |
| 3,478,394 A | * | 11/1969 | Davis | |
| 4,222,609 A | * | 9/1980 | Anderson | |
| 4,928,929 A | | 5/1990 | Kinder | |
| 4,986,389 A | | 1/1991 | Halligan, Sr. et al. | |
| 5,193,955 A | * | 3/1993 | Chou | 410/100 |
| 5,247,836 A | | 9/1993 | Hall et al. | |
| 5,443,110 A | | 8/1995 | Plott, Sr. | |
| 5,452,973 A | * | 9/1995 | Arvin | 410/117 |
| 5,458,447 A | * | 10/1995 | Clason | 410/100 |
| 5,671,948 A | * | 9/1997 | Susko et al. | |
| 5,738,160 A | * | 4/1998 | Rice | |
| 5,752,459 A | | 5/1998 | Rexroad | |
| 5,787,955 A | | 8/1998 | Dargie | |
| 6,068,085 A | | 5/2000 | Denny et al. | |
| 6,182,790 B1 | | 2/2001 | Denny et al. | |

FOREIGN PATENT DOCUMENTS

| | | |
|---|---|---|
| DE | 19720388 | 10/1998 |
| FR | 2 757 555 | 12/1996 |
| WO | WO 99/58790 | 11/1999 |
| WO | WO 00/04955 | 2/2000 |

* cited by examiner

*Primary Examiner*—Alvin Chin-Shue
(74) *Attorney, Agent, or Firm*—Workman Nydegger

(57) ABSTRACT

A safety net (1) for an opening (11), eg. an open stairwell in a construction site, where the safety net (1) comprises a plurality of straps (2) in a grid arrangement. The straps (2) consist of seat belt webbing or a similar material. The safety net (1) also comprises adjustable anchoring means (4, 14, 25) for anchoring ends of the straps to the perimeter (10) of the opening (11).

15 Claims, 6 Drawing Sheets

SAFETY NET

FIELD OF INVENTION

This invention relates to a safety net for use during building construction or the like, and more particularly, but not exclusively, relates to an improved safety net for the prevention of builders or workers falling through an opening in a multiple storey construction site.

BACKGROUND OF THE INVENTION

Safety nets for use in the building industry are known and generally comprise a mesh net of relatively thin cords or the like attached at its perimeter to a metal frame. These types of nets are commonly used on the exterior of buildings underneath scaffolding to catch falling workers or building materials. Similar nets may be used inside buildings to cover openings in the floors, such as stairwells, whereby the metal frame is required to be securely attached adjacent the edges of the opening.

The metal frame of these nets prohibits the net being universally adaptable to openings of different sizes and configurations. Furthermore, the metal frame bordering the perimeter of the safety net can be bulky, difficult to install and provide an obstruction which workers may trip over.

Where the safety net comprises a mesh net bordered by a guide cable which is anchored to the metal frame, several problems arise. Firstly, a worker falling into the net may be injured by the metal attachments, which project into the space of the aperture and secure the guide cable to the metal frame. Secondly, where the guide cable breaks or fails, the safety net is rendered useless as there is nothing to support the safety net. Finally, a closely spaced mesh net may lead workers to believe that the net is safe to be walked across. Upon attempting to walk across the net the worker may fall or trip and be injured.

Similarly important is the inadequacy of current safety nets to provide means by which the net may be adjusted to accommodate differently sized openings. Safety nets which comprise a metal frame require the frame and/or guide cable to be adjusted, which is time consuming and difficult, in order to fit the dimensions of different apertures. Alternatively, construction companies may require a range of metal frame safety nets of predetermined size. However, this is costly.

Furthermore, current safety nets also fail to provide a means for the passage of workers and building materials through a portion of the net while the safety net remains in place and retains full structural integrity.

It is therefore desirable to provide a safety net which can be adapted to various aperture sizes and retains significant strength upon failure or release of one or more support attachments.

SUMMARY OF THE INVENTION

According to one aspect of the invention there is provided a safety net for an opening, said safety net comprising a plurality of straps in a grid arrangement, said straps consisting of seat belt webbing or similar material, and anchoring means for anchoring the ends of the straps to the perimeter of said opening.

Preferably, the anchoring means for the straps are adjustable to allow the net to be adjusted to fit openings of different sizes. In a preferred embodiment, the anchoring means may comprise a metal plate having a first anchor portion adapted to be secured around the opening by fixing means, such as screws or bolts, or the like, and a second portion which includes spaced slots through which the end of a strap is threaded, thereby providing a secure adjustable fastening. In one preferred embodiment, the second portion is hingedly connected to the first anchor portion of the anchoring plate.

In a further embodiment the anchoring means comprises a quick-release anchor in which the first and second portions are formed separately as first and second parts adapted to be releasably locked together. The second part may include an integrally formed lug. The first anchor part may include an aperture adapted to receive and releasably lock the lug of the second anchor part. Preferably, the lug and the aperture of the first anchor part are T-shaped. Furthermore, the first and second anchor parts may be adapted for substantially flush alignment when the first and second anchor parts are releasably locked.

The safety net may also include a gap in one corner or along one side of the safety net to permit the transmission of building materials or workers, e.g. via a ladder, between adjacent levels of a building or construction site. This gap may be enlarged without substantially affecting the strength and integrity of the net due to the use of seat belt webbing to form the safety net and the use of separate anchor points on the ends of each strap. The construction of the invention also assists to maintain an adequate strength of the safety net where some of the straps or anchors fail.

A preferred embodiment of the present invention will now be described, by way of example only, with reference to the accompanying drawings, in which.

DESCRIPTION OF THE PREFERRED EMBODIMENTS

The safety net shown in FIGS. 1 to 9 comprises a plurality of straps 2 in a substantially orthogonal grid arrangement whereby the straps are connected at their intersection points 3 e.g. by stitching and anchor plates 4, 14, 26, 27 are attached to the ends of the straps.

Figure 1:
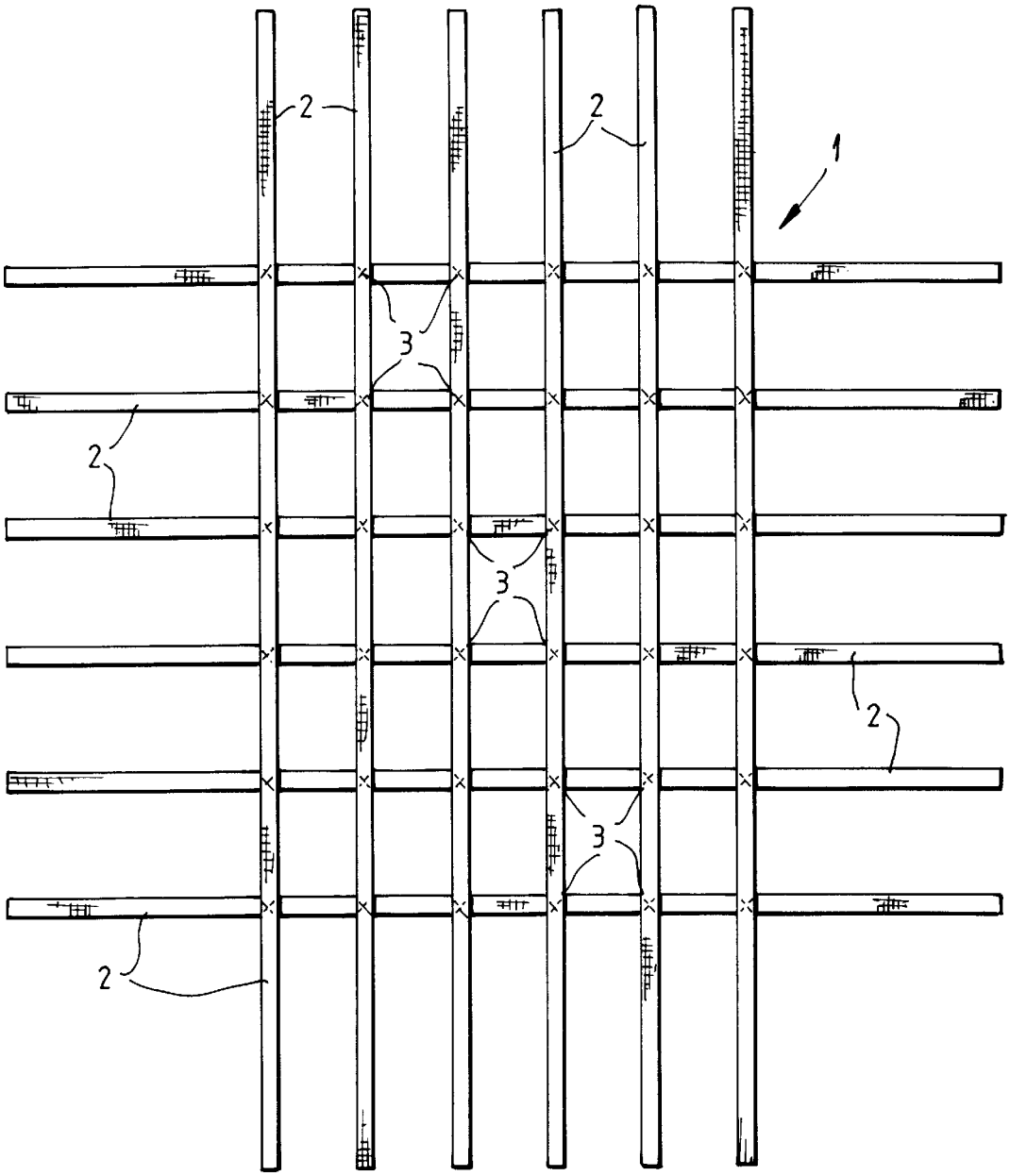
FIG. 1 is a plan view of a safety net, without the anchors, in accordance with the invention.

As shown in FIG. 1, the safety net 1 may generally define a rectangular section. However, it should be appreciated that the number of straps 2 comprising the safety net 1 may vary depending on the size of the safety net 1 manufactured. The straps 2 comprising the safety net 1 are preferably formed from an industrial webbing material of the type which is used to make seat belts in vehicles. This may be polyester or nylon, but may equally be formed from other appropriate materials. The webbing is cut into lengths which are appropriate for making a safety net 1 of the desired size.

The ends of each strap 2 may extend beyond the outer perimeter of intersection points 3 by up to about 1 m but preferably by no less than 800 mm.

Figure 2:
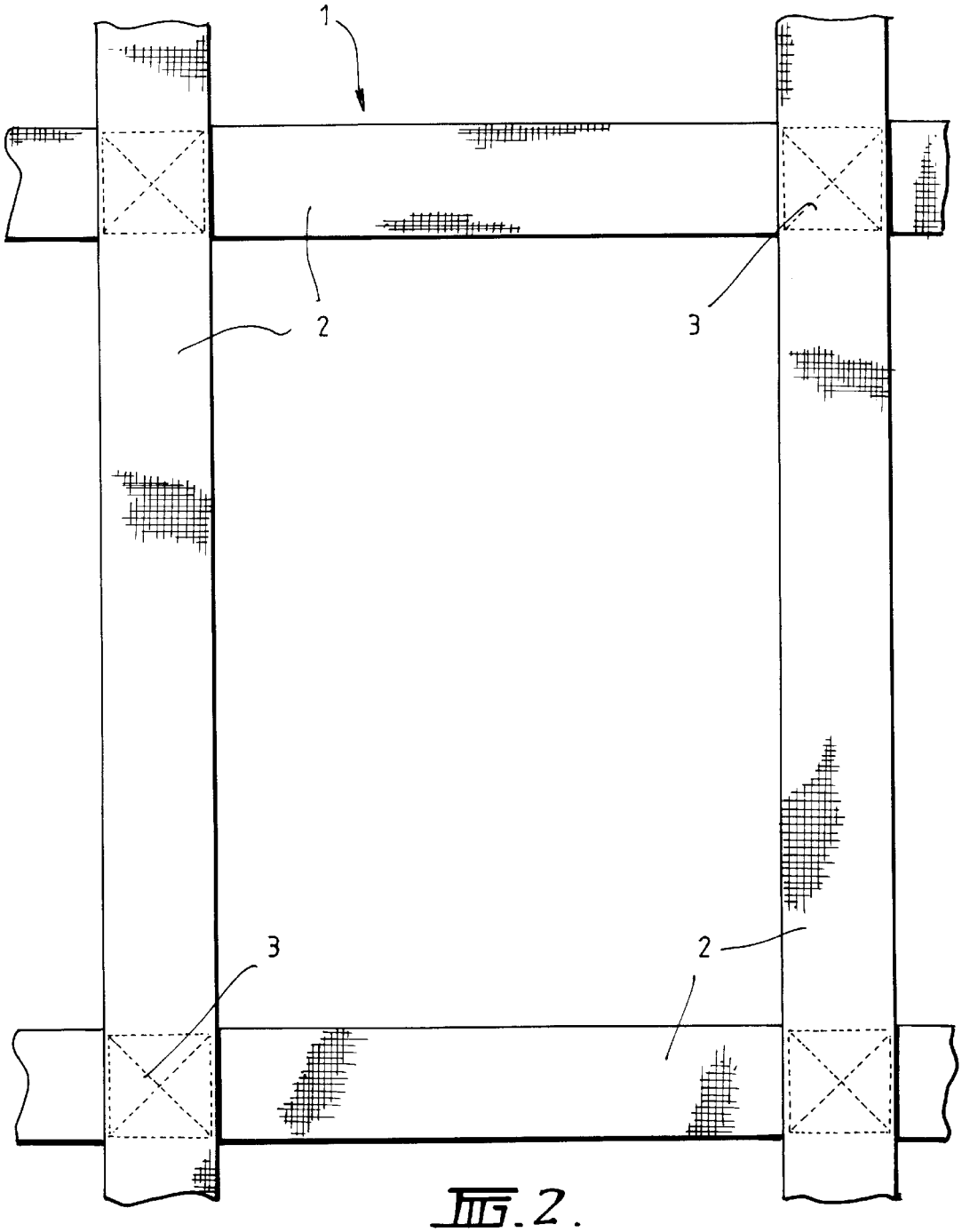
FIG. 2 shows the intersection points of orthogonally arranged straps.
Figure 4:
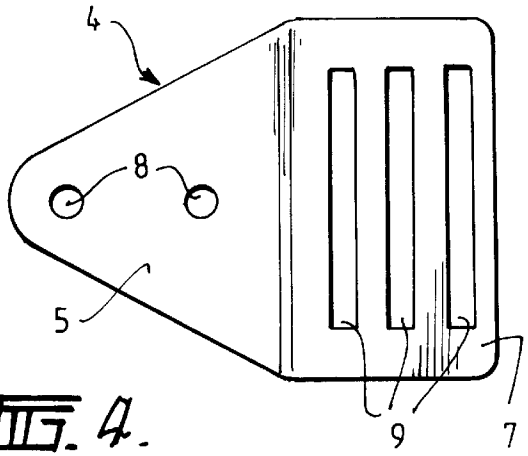
FIG. 4 is a plan view of the anchor plate of FIG. 3.

FIG. 2 shows the intersection points 3 of four straps 2. According to the preferred embodiment, intersecting straps 2 are attached to each other by sewing no less than 3 mm from the edge of the straps using heavy duty thread. According to a preferred embodiment, this thread is formed from a strong synthetic material, such as nylon. However, it is envisaged that other appropriate synthetic and non-synthetic materials may be used. Such means of attachment permanently fixes the straps in a substantially orthogonal grid arrangement, whereby the distance between any two parallel straps 2 is preferably no more than 250 mm. This construction provides the safety net 1 with substantial strength to support the weight of a worker falling on the net. It also allows the workers to see through the safety net 1 and providing a disincentive to workers considering walking over the safety net 1. If a worker attempts to walk over the safety net, it is likely that one leg will pass through the net, but the spacing between straps should ensure that he does not fall completely through the net, with the weight of the worker supported by the net.

Independent strength tests have been carried out on a safety net system in accordance with the invention and the ultimate tensile strength of the weakest link of the system was found to be about 6.7 kN. A free fall drop test was also conducted on the system by allowing a 120 kg sand bag to fall freely from 1.8 m. Even under these severe operating conditions, the tension produced at the most critical location was 4.0 kN, significantly less than the ultimate tensile strength of the weakest component (6.7 kN). Therefore, based on tests performed and under extreme conditions, the safety net system is only expected to be subjected to 60% of its ultimate tensile strength.

Figure 3:
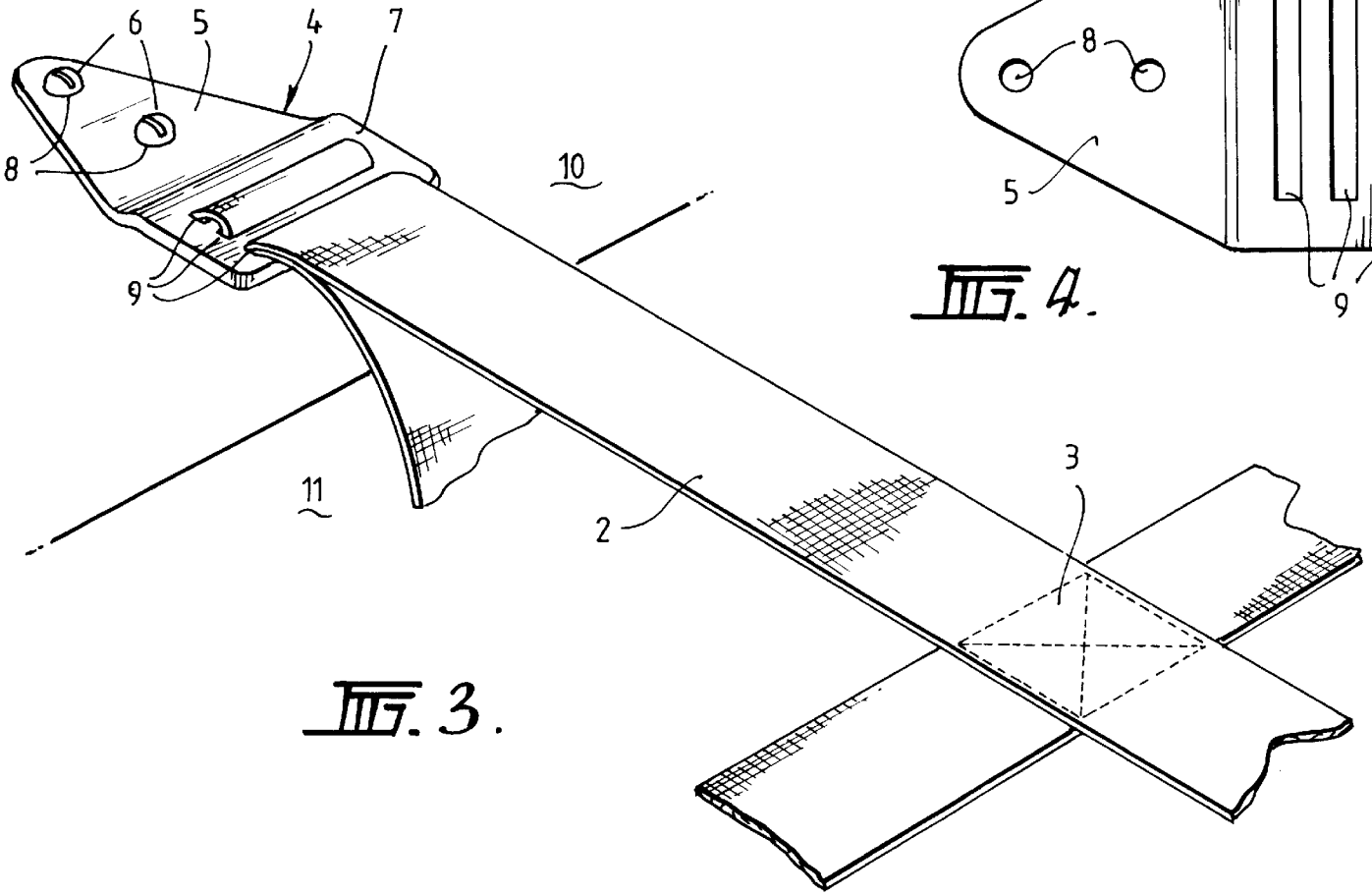
FIG. 3 shows one form of an anchor plate attached to a floor surrounding an opening with the end of a strap threaded through the anchor.

FIG. 3 shows the way in which an end of a strap 2 engages with one form of anchor plate 4. The anchor plate 4 shown in FIGS. 3 and 4 comprises a metal plate having a generally triangular-shaped anchoring portion 5 with fixing holes 8 for receiving fixing members and a strap-securing portion 7 having a plurality of elongate apertures or slots 9.

In a preferred embodiment, the anchor plate 4 is formed from a plate of stainless steel 3–4 mm thick, approximately 105 mm long and 70 mm wide. The width of the apertures or slots 9 is preferably 3–4 mm and the distance between the slots is preferably at least 9 mm. It will, however, be appreciated that the form and dimensions of the anchor plate 4 may be varied for different strength requirements.

In use as shown in FIG. 3, the anchoring portion 5 is secured, e.g. by fixing screws 6, to the floor 10 surrounding an opening 11 in a building, such as a stairwell, and the end of a strap 2 of the net is threaded through the slots 9 to secure the strap to the anchor plate 4. The threaded engagement of the strap 2 with the apertures in the anchor 4 allows the distance between the anchor and the outermost intersection point 3 of the net to be adjusted and, therefore, allows the safety net 1 to be configured for openings of varying sizes.

The members for securing the anchor plate 4 to the floor of a building, are preferably removable members such as screws 6, as shown in FIG. 3. However, alternative methods of fixing other than screws may be used. The manner in which the anchor is fixed results in a shear force being placed on the means of securing the anchor to the building and the hinge 9 and 10 in the anchor when tension is placed on the straps 2.

Figure 5:
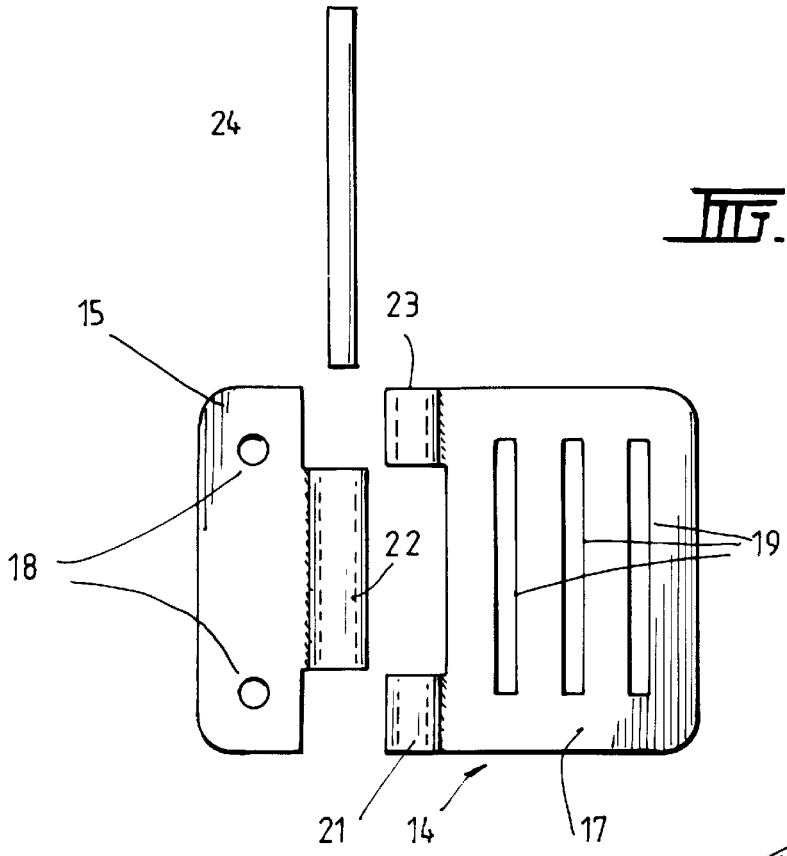
FIG. 5 is a plan view of the components of another form of anchor plate.
Figure 6:
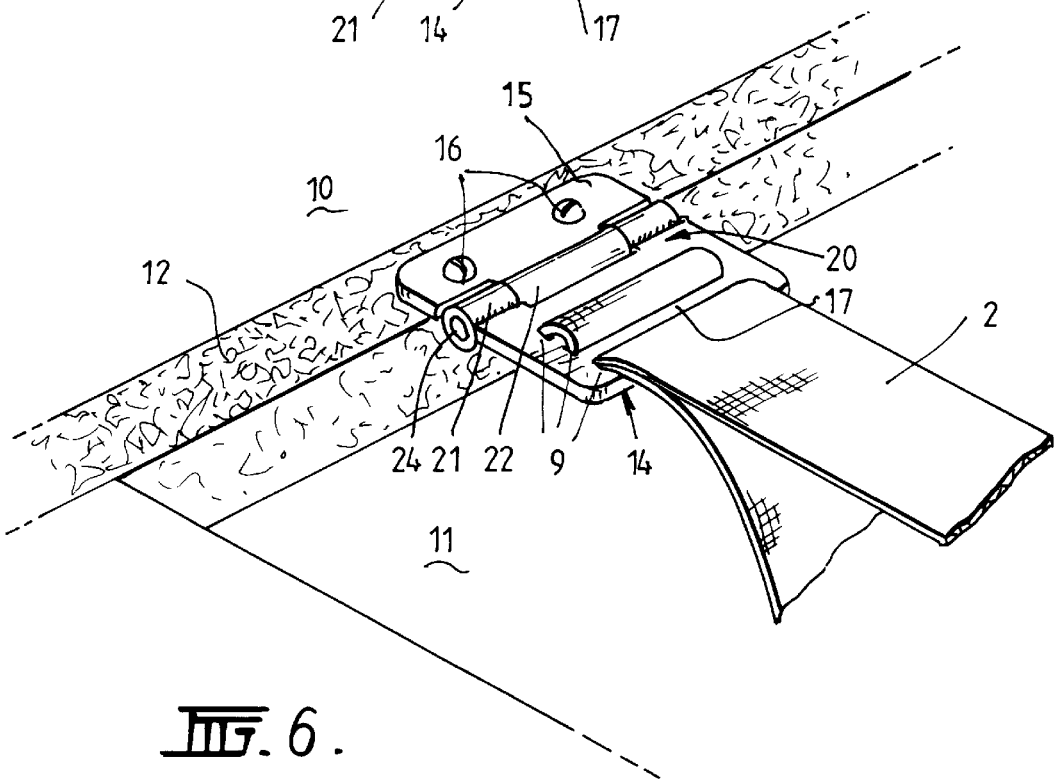
FIG. 6 shows the anchor plate of FIG. 5 in use.
Figure 9:
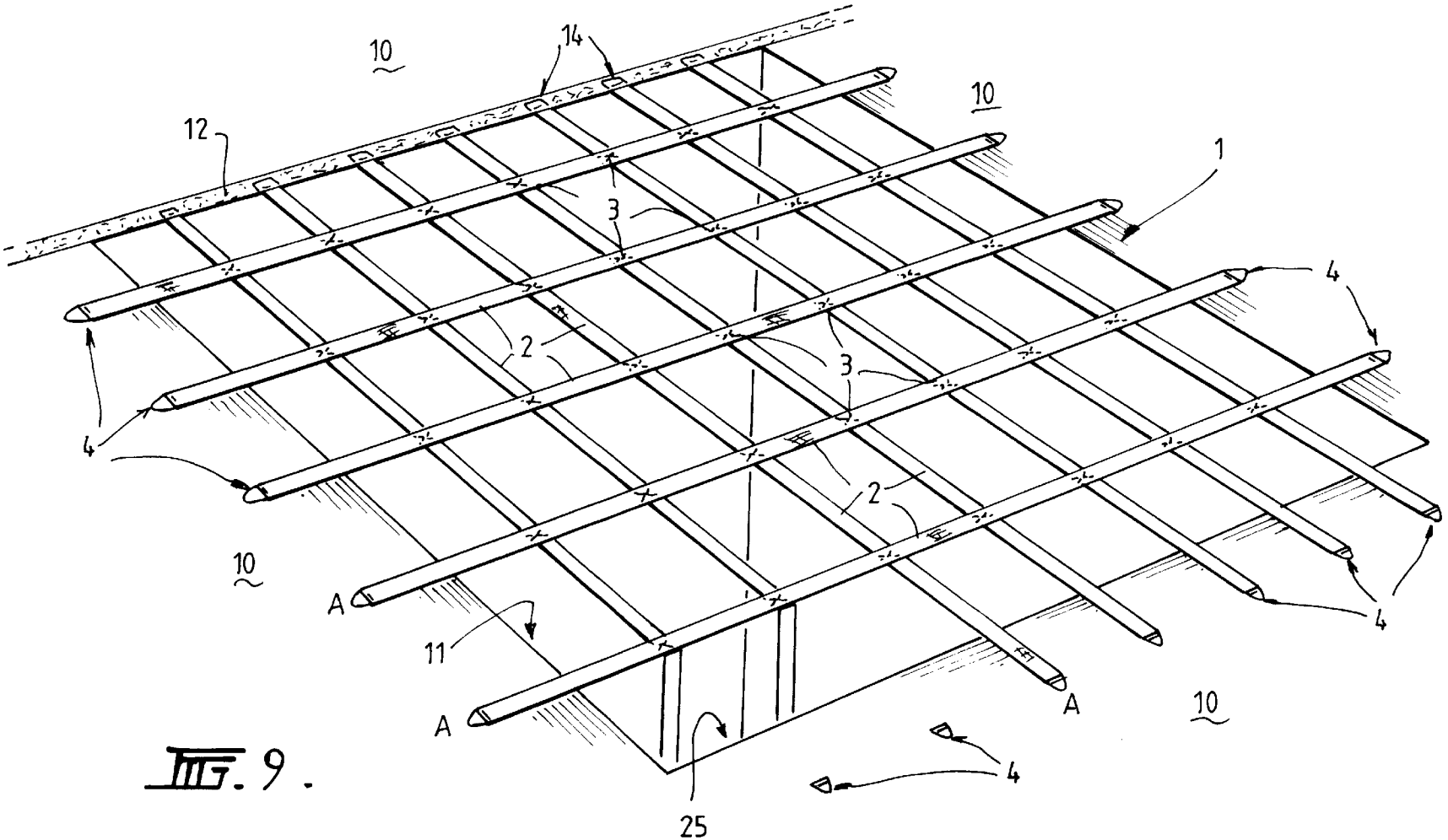
FIG. 9 shows the safety net anchored in position across an opening, such as a stairwell in a building.

When the safety net is to be used for a stairwell opening 11 in a multi-storey building as shown in FIGS. 6 and 9, the strap ends on at least one side of the opening 11 may be required to be attached to an expansion joint 12 of the building structure rather than to the floor 10 surrounding the opening 11. For this purpose a hinged anchor plate 14 such as shown in FIGS. 5 and 6 is preferably provided.

The anchor plate 14, as depicted in FIG. 5, comprises a first anchoring portion 15 hingedly connected to a second strap-securing portion 17. The first anchoring portion 15 includes two laterally spaced apart fixing holes 18 for use in fixing the anchor plate 14 to the expansion joint 12 of the building. The holes 18 are of sufficient size and shape to allow screws, or other means of attachment, to fix the anchor plate 14 to the expansion joint 12. The second strap-securing portion 17 preferably incorporates three spaced apart laterally extending elongate apertures or slots 19.

The anchoring portion 15 and the strap-securing portion 17 are joined by a hinge 20 comprising three tubular sections 21, 22, 23 alternately welded to the first and second portions 15 and 17, through which a rod 24 is inserted to form the hinge 20.

Preferably, the anchor plate 14 is about 70 mm in width and about 80 mm in length. The holes 18 in the first portion 15 are approximately 7 mm in diameter and the slots in the second portion 17 are preferably 50 mm long and 4 mm wide, with the slot closest the hinge 20 being 3 mm wide. It is further preferable that the first and second hinged portions 15 and 17 are formed from 3–4 mm thick stainless steel. However, it will be appreciated that the form and dimensions of the hinged anchor plate 14 and its holes and slots may be varied for different strength requirements.

In use, as shown in FIG. 6, the anchoring portion 15 of the hinged anchor plate 14 is secured, e.g. by fixing screws 16, to the expansion joint 12 at one side of the opening 11 and the end of a respective strap 2 is threaded through the slots 19 to secure the strap 2 to the anchor plate 14. The hinged anchor plate 14 is specifically designed for anchoring the ends of straps 12 to a relatively narrow member such as an expansion joint 12 with the hinge 20 of the plate 14 relieving possible shear forces on the plate when heavy items fall on the safety net, placing tension on the straps 2. While the anchoring portion 15 is illustrated in FIG. 6 as being secured to a horizontal surface, the anchor portion 15 is equally adapted to be secured to a vertical surface.

Figure 7B:
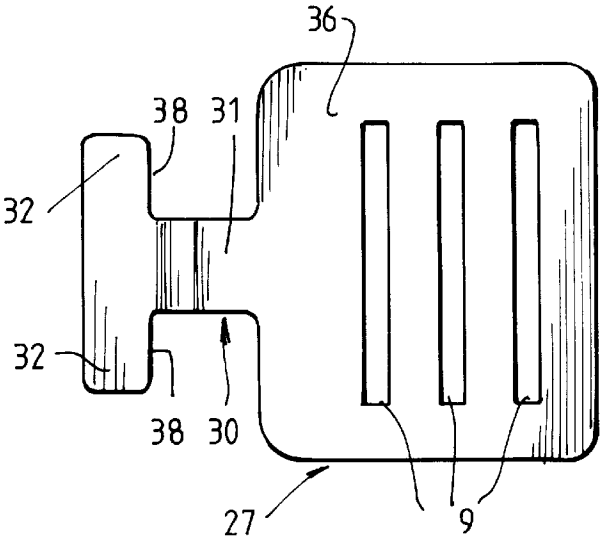
FIGS. 7A and 7B are plan view of the components forming a quick release anchor.
Figure 7A:
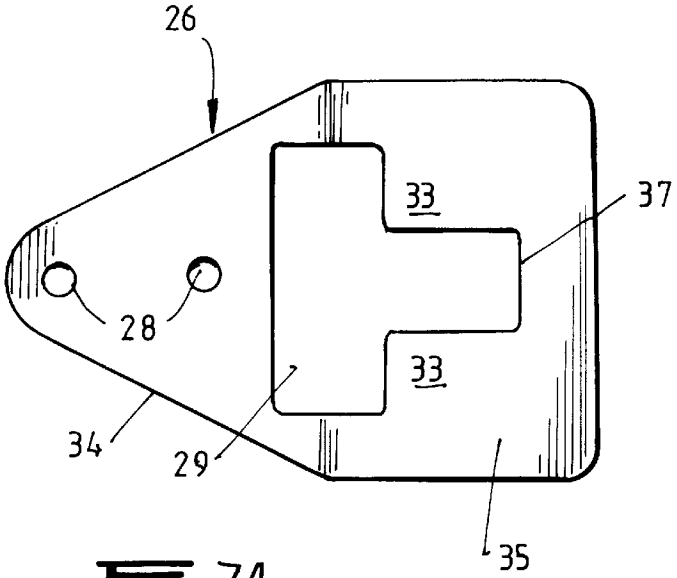

One or more of the anchor plates 4, 14 may be substituted with a quick release anchor 25 formed in first and second parts 26, 27 as depicted in FIGS. 7A and 7B. The quick release anchor 25 provides a secure anchor point for straps 2 of the net, whilst also being readily releasable to create a gap in a corner or side of the net for workers or materials to pass through, without having to undo the threading of the strap through the second part 27 of the quick release anchor 25.

As shown in FIG. 7A, a first part 26 of the quick release anchor 25 includes a substantially triangular-shaped anchoring portion 34 integrally joined with a substantially rectangular-shaped receiving portion 35. The anchoring portion 34 includes two apertures 28 for receiving therethrough fixing means in the form of screws, bolts or the like, whereby the first part 26 may be fixed to the floor 10 surrounding an opening. The receiving portion 35 includes a receiving aperture 29 in the form of a T-shape, however, other shaped apertures may be equally applicable.

A second part 27 of the quick release anchor 25 comprises a substantially square or rectangular-shaped portion 36 with three parallel slots 9 for threadedly receiving a strap 2. A lug 30 is provided on the second part 27. The lug 30 preferably has a central body portion 31 joined at one end to the portion 36 and having end portions 32 at its other end which extend transversely of the body portion 31 to thereby define a T-shaped lug 30.

Preferably, the first and second parts 26, 27 are 3–4 mm thick and about 70 mm wide. The T-shaped aperture 29 may be 48 mm in width across the cross-bar and 35 mm in height. The slots 9 are preferably 4 mm in width and 50 mm long with the slot 9 closest the T-shape lug 30 being 3 mm in width. The slots 9 may be spaced 9 mm apart. Preferably the body portion 31 of the lug 30 is 16 mm wide and 20 mm long, while the cross-bar of the T-shaped lug 30 may be 12 mm high and 45 mm wide. Furthermore, the apertures 28 are preferably 7 mm in diameter.

In operation, the first part 26 will be secured to the floor 10, for instance, of a building via fixing means through apertures 28. The end of a strap 2 is adjustably threaded through the slots 9 in the second part 27.

The first and second parts 26, 27 are locked together by firstly aligning the T-shaped lug 30 of the second part 27 with the T-shaped aperture 29 in the first part 26. The end portions 32 are then passed through the cross-bar portion of the T-shaped aperture 29 so the end portions 32 move below the level of the T-shaped aperture 29. The first and second parts 26, 27 are then moved away from each other so the end portions 32 of the lug 30 move behind the shoulders 33 defined by the T-shaped aperture 29, while square portion 36 of the second part 27 remains on top of the first part 26.

The first and second parts 26, 27 are finally locked when shoulder portions 38 on the T-shaped lug 30 abut the bottom extremity 37 of the T-shaped aperture 29. Performing the above process in reverse unlocks the first and second parts 26, 27.

Figure 8:
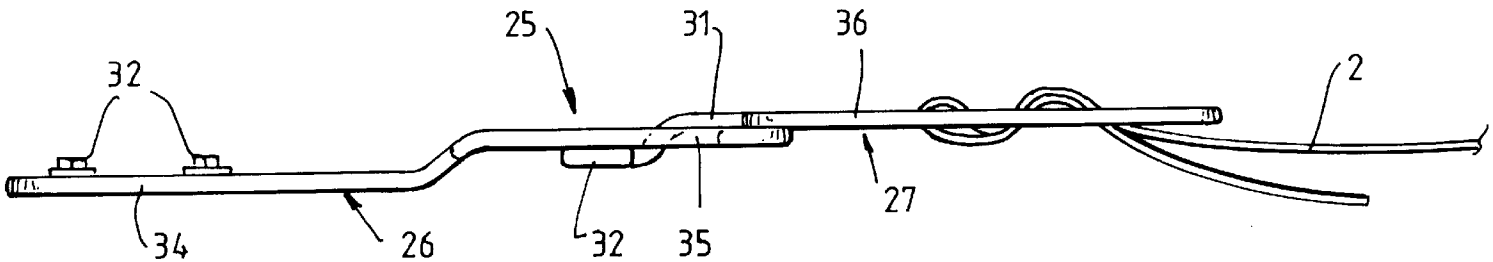
FIG. 8 is a side elevational view of the quick release anchor of FIGS. 7A and 7B in the locked position.

Preferably, the first and second parts 26, 27 are shaped to provide flush alignment while in the locked position as shown in FIG. 8. As shown in FIGS. 7A, 7B and 8, this may be achieved by contouring a portion of the first part 26 intermediate the anchoring portion 34 and receiving portion 35. The body portion 31 of the T-shaped lug 30 may be equally contoured, so in the locked position the end portions 32 are substantially flush with a rear surface of the first part 26, while the second part 27 is also substantially flush with a front surface of the first part 26.

The quick release mechanism 26, 27 is preferably retained in the locked position by the weight of the net so that additional locks or latches are not required. Accordingly, the quick release anchor 26, 27 may be easily released by sliding the T-shaped lug 30 out of engagement with the T-shaped aperture 29. Equally, re-engagement effects locking of the quick release anchor. In this manner, temporary gaps in the safety net 1 may be quickly created and closed to ensure that the safety net 1 remains covering the opening 11 to a maximum extent, rather than have a gap ever present in the safety net 1.

FIG. 9 depicts the preferred embodiment of the safety net in use where the straps 2 in an orthogonal grid arrangement are disposed over an opening 11 in the floor 10 of a building under construction. The end of each strap 2 comprising the safety net overlaps the perimeter of the aperture 11 and is anchored to the floor 10 or expansion joint 12 of the building by separate anchor plates 4, 14 or 26, 27.

Where the frequency of movement of workers or materials between adjacent floors of the building through the net is high, the safety net may be constructed to include a gap 25, instead of, or in addition to, the use of quick release anchors 26, 27.

The gap 25 may provide access for workers via a ladder (not shown) to the floor of the building below the safety net 1. The construction of the safety net in the manner described above preferably allows for the ends of the straps 2 to be released from the anchor points (marked A in FIG. 6) such that a larger gap in the net can be provided. This larger gap allows workers to pass large or bulky building materials, or the like, through the opening while the remainder of the safety net 1 remains in place guarding against people or objects falling through the remainder of the opening 11.

A safety net provided with anchor plates 4, 14 and 25 on the ends of each strap has the capacity to catch heavy items falling onto the net and still retain its structural integrity and strength where some anchors or straps fail or are released. Further, the anchor plates 4, 14 and 25 provide adjustable anchor points for the straps 2 enabling the effective size of the safety net to be varied for different sizes or openings.

It will be appreciated that various modifications may be made to the preferred embodiment described above without departing from the scope or spirit of the invention.

I claim:

1. A building site including an opening and a safety net to cover the opening, the safety net comprising:

a plurality of straps in a grid arrangement extending across the opening, the straps being of webbing material and the net being of sufficient strength to support a falling worker the straps having interconnections at their points of intersection, the straps on at least two adjacent sides of the net including end portions that extend beyond the interconnections, and a plurality of anchors which anchor the net to a perimeter of the opening, at least some of the anchors are adjustable anchors, the adjustable anchors comprising an anchor portion which anchors the net to the perimeter of the opening and a strap securing portion to which the end of one of the straps is adjustably secured at a selected adjustable spacing from the interconnections the adjustable anchors being spaced at intermediate positions least along the two adjacent side of the net such that the effective area of the net is adjustable to fit a particular size of the opening, the strap securing portion being disposed immediately proximate to the anchor portion and thereby within easy reach of a worker located proximate the opening, the anchor portion of the adjustable anchors comprises an anchor plate having one or more apertures with one or more fasteners extending therethrough and securing the anchor plate to the perimeter of the opening, the strap securing portion comprising a strap securing plate having spaced slots through with the end portion of one of the straps is threaded, thereby providing a secure adjustable fastening, the anchor plate and the strap securing plate being directly connected to each other in a substantially flush alignment.

2. The building site as claimed in claim 1, wherein a gap is provided between the net and the perimeter of the opening to permit the transmission of building materials, workers or equipment between the adjacent levels of the building site.

3. The safety net according to claim 1, wherein the anchor plate and the strap securing plate are hingeably connected to each other.

4. The safety net according to claim 1, wherein the anchor plate and the strap securing plate are integral.

5. A safety net according to claim 1, wherein the adjustable anchors are of a quick release type.

6. A safety net according to claim 5, further comprising a lug that extends from the strap securing portion, and an opening in the anchor portion receives and releasably locks the tab of the strap securing portion.

7. A safety net according to claim 6, wherein the lug is integrally formed with the second anchor portion and has end portions extending transversely of the lug.

8. A safety net according to claim 6, wherein the lug is T-shaped.

9. A safety net according to claim 1, wherein the anchor plate is comprised of a metal plate.

10. A safety net according to claim 1, wherein the plurality of straps are in substantially orthogonal alignment.

11. A safety net according to claim 1, wherein the straps are sewn together at their intersection points.

12. A safety net according to claim 1, wherein the seatbelt webbing is made of polyester or nylon.

13. A safety net according to claim 8, wherein the opening in the first anchor position is T-shaped.

14. A safety net according to claim 1, wherein the straps are positioned so that the distance between adjacent straps is no more than 250 mm.

15. A building site according to claim 1, wherein each of the anchors on each of four sides is an adjustable anchor.

* * * * *

UNITED STATES PATENT AND TRADEMARK OFFICE

CERTIFICATE OF CORRECTION

PATENT NO. : 6,776,260 B2
DATED : August 17, 2004
INVENTOR(S) : Vlado Cjepa

It is certified that error appears in the above-identified patent and that said Letters Patent is hereby corrected as shown below:

Column 2,
Line 43, after “plan” change “view” to -- views --

Column 6,
Lines 38 and 39, “spaced at” remove “intermediate positions”
Line 39, after “adjacent” change “side” to -- sides --

Signed and Sealed this

Twenty-eighth Day of December, 2004

JON W. DUDAS
*Director of the United States Patent and Trademark Office*